US012520909B2

(12) United States Patent
Mazzarolo et al.

(10) Patent No.: US 12,520,909 B2
(45) Date of Patent: Jan. 13, 2026

(54) FOOTWEAR WITH RETENTION SYSTEM

(71) Applicant: ALPINESTARS RESEARCH S.P.A., Maser (IT)

(72) Inventors: Giovanni Mazzarolo, Coste di Maser (IT); Andrea Marini, Volpago del Montello (IT); Silvano Spada, Canale Monterano (IT)

(73) Assignee: ALPINESTARS RESEARCH S.P.A., Maser (IT)

( * ) Notice: Subject to any disclaimer, the term of this patent is extended or adjusted under 35 U.S.C. 154(b) by 2 days.

(21) Appl. No.: 18/565,508

(22) PCT Filed: May 27, 2022

(86) PCT No.: PCT/IB2022/054995
§ 371 (c)(1),
(2) Date: Nov. 29, 2023

(87) PCT Pub. No.: WO2022/254295
PCT Pub. Date: Dec. 8, 2022

(65) Prior Publication Data

US 2024/0237785 A1 Jul. 18, 2024

(30) Foreign Application Priority Data

May 31, 2021 (IT) ..... 102021000014261

(51) Int. Cl.
*A43C 11/22* (2006.01)
*A43C 11/14* (2006.01)

(52) U.S. Cl.
CPC ..... *A43C 11/22* (2013.01); *A43C 11/1493* (2013.01)

(58) Field of Classification Search
CPC ..... A43C 11/00; A43C 11/14; A43C 11/1493; A43C 11/16; A43C 11/165; A43C 11/20; A43C 7/08; A43C 1/003; A43B 23/0265
See application file for complete search history.

(56) References Cited

U.S. PATENT DOCUMENTS 4,924,605 A * 5/1990 Spademan ..... A43B 5/0441 36/114
5,177,882 A * 1/1993 Berger ..... A43C 11/165 36/50.1

(Continued)

FOREIGN PATENT DOCUMENTS

KR 101868466 B1 6/2018

OTHER PUBLICATIONS

International Search Report and Written Opinion of the International Application No. PCT/IB2022/054995, mailed Sep. 1, 2022, 2022, 13 pg.

*Primary Examiner* — Heather Mangine
(74) *Attorney, Agent, or Firm* — Fredrikson & Byron, P.A.

(57) ABSTRACT

Footwear (1) with retention system (2) comprising an upper (4) delimiting an inner space; the retention system (2) is positioned at least partially in the inner space and comprises at least one constraint element (10A, 10B, 10C) designed to be positioned at the top instep area or at the side/heel area of the foot of the user, the at least one constraint element (10A, 10B, 10C) being designed to pass from a loose condition to a tightened condition and vice versa. The retention system (2) further comprises a cord (14) slidably coupled to the at least one constraint element (10A, 10B, 10C), tensioning means (22) connected to a first portion (15) of the cord (14) and designed to be handled by the user for pulling the cord (14) into a tensioned condition to bring the (Continued)

at least one constraint element (10) in the tightened condition and locking means (24) for locking the cord (14) in tensioned condition.

8 Claims, 8 Drawing Sheets

(56) References Cited

U.S. PATENT DOCUMENTS 5,755,044 A * 5/1998 Veylupek ..... A43C 3/00 36/50.1
6,119,372 A * 9/2000 Okajima ..... A43B 11/00 36/50.1
6,286,233 B1 * 9/2001 Gaither ..... A43C 1/00 36/50.1
6,467,194 B1 * 10/2002 Johnson ..... A43C 1/06 36/118.1
D476,144 S * 6/2003 Adams ..... D2/969
7,370,440 B1 * 5/2008 Cole, III ..... A43C 11/008 36/88
7,428,789 B2 * 9/2008 Holzer ..... A43B 5/0411 36/117.6
7,591,050 B2 * 9/2009 Hammerslag ..... A43C 11/00 36/50.5
8,578,632 B2 * 11/2013 Bell ..... A43C 1/04 36/88
9,049,902 B2 * 6/2015 Baker ..... A43B 23/00
9,375,052 B2 * 6/2016 Krueger ..... A43C 1/003
11,382,382 B2 * 7/2022 Oden ..... A43B 23/027
11,589,653 B2 * 2/2023 Hopkins ..... A43C 1/06
11,758,981 B2 * 9/2023 Maselino ..... A43C 1/06 36/50.1
12,127,632 B2 * 10/2024 Soderberg ..... A43C 11/165
12,262,793 B2 * 4/2025 Zwick ..... A43B 5/025
2004/0074110 A1 * 4/2004 Borsoi ..... A43B 23/0235 36/117.1
2004/0181972 A1 * 9/2004 Csorba ..... A43B 23/0265 36/50.1
2006/0000116 A1 * 1/2006 Brewer ..... A43C 1/04 36/11.5
2006/0191164 A1 * 8/2006 Dinndorf ..... A43B 7/14 36/50.1
2006/0196083 A1 * 9/2006 Martin ..... A43B 7/20 36/50.5
2007/0011914 A1 * 1/2007 Keen ..... A43B 7/1495 36/50.1
2007/0033836 A1 * 2/2007 Rasmussen ..... A43B 1/0081 36/50.1
2007/0043630 A1 * 2/2007 Lyden ..... A43D 11/006 705/26.5
2007/0209234 A1 * 9/2007 Chou ..... A43B 11/00 36/138
2009/0071041 A1 * 3/2009 Hooper ..... A43C 11/14 36/25 R
2009/0199435 A1 * 8/2009 Robinson, Jr. ..... A43C 11/165 36/108
2011/0088283 A1 * 4/2011 Berthet ..... A43B 5/0411 36/50.1
2012/0291242 A1 * 11/2012 Donnadieu ..... A43C 11/20 24/712.7
2013/0104423 A1 * 5/2013 Hatfield ..... A43B 23/0235 36/103
2013/0205622 A1 * 8/2013 Harald ..... A43B 5/0401 36/117.1
2013/0276330 A1 10/2013 Dinndorf et al.
2015/0089839 A1 * 4/2015 James ..... A43C 11/004 36/102
2015/0257489 A1 * 9/2015 Trudel ..... A43B 5/003 12/142 LC
2015/0313318 A1 * 11/2015 Gibb ..... A43C 7/00 36/58.5
2015/0359296 A1 * 12/2015 Gulla ..... A43B 5/0429 36/109
2016/0058127 A1 * 3/2016 Burns ..... A45F 5/02 36/58.5
2016/0213089 A1 * 7/2016 Chen ..... A43B 23/025
2016/0270484 A1 * 9/2016 Zadnik ..... A43C 1/06
2018/0020767 A1 * 1/2018 Dyer ..... A43B 23/0245 36/97
2018/0020774 A1 * 1/2018 Chang ..... A43C 1/02 36/102
2018/0035760 A1 * 2/2018 Bock ..... A43C 11/165
2018/0110294 A1 * 4/2018 Schneider ..... A43B 3/38
2018/0110298 A1 * 4/2018 Schneider ..... A43C 11/008
2018/0116343 A1 * 5/2018 Hei ..... A43C 11/00
2018/0255877 A1 * 9/2018 Wilson ..... A43B 23/0245
2018/0352898 A1 * 12/2018 Onoda ..... A43B 7/1475
2019/0274393 A1 * 9/2019 Koo ..... A43C 1/04
2019/0313742 A1 * 10/2019 Bell ..... A43B 1/0054
2019/0380438 A1 * 12/2019 Luh ..... D04B 1/123
2020/0077748 A1 * 3/2020 Dyer ..... A43B 11/00
2020/0138145 A1 * 5/2020 Greenspan ..... A43C 1/003
2020/0205524 A1 * 7/2020 Hatfield ..... A43B 11/00
2020/0305555 A1 * 10/2020 Yamamoto ..... A43C 11/165
2021/0093046 A1 * 4/2021 Lam ..... A43C 1/003
2021/0112922 A1 * 4/2021 Bock ..... A43C 1/006
2021/0235819 A1 * 8/2021 Andreasen ..... A43B 23/26
2021/0259359 A1 * 8/2021 Maselino ..... A43B 7/1435
2021/0330036 A1 * 10/2021 Labelle ..... A43B 3/34
2022/0015509 A1 * 1/2022 Yun ..... A43C 11/008
2022/0110401 A1 * 4/2022 Crumbleholme ..... A43C 11/16
2022/0151342 A1 * 5/2022 Swigart ..... A43B 23/0275
2022/0225736 A1 * 7/2022 Kagami ..... A43C 11/1493
2022/0279898 A1 * 9/2022 Singh ..... D04B 1/24
2022/0279900 A1 * 9/2022 Vladika ..... A43C 1/003
2023/0030523 A1 * 2/2023 Keegan ..... A43B 7/18
2023/0148712 A1 * 5/2023 Ouchi ..... A43C 1/003 24/68 SK
2023/0189936 A1 * 6/2023 Siegismund ..... A43C 11/16 36/50.1
2023/0363488 A1 * 11/2023 Oberhauser ..... A43B 5/0439
2024/0237785 A1 * 7/2024 Mazzarolo ..... A43C 1/003

* cited by examiner

FOOTWEAR WITH RETENTION SYSTEM

RELATED APPLICATIONS

This application is a 35 U.S.C. 371 national stage filing from International Application No. PCT/IB2022/054995, filed May 27, 2022, which claims priority to Italian Patent Application No. 102021000014261, filed May 31, 2021. The entire contents of each of these applications is incorporated herein by reference in their entirety.

The present invention relates to the technical field of footwear and in particular it relates to a footwear having a retention system.

FIELD OF THE INVENTION

In particular, the footwear of the present invention is a laceless footwear and preferably belongs to the group comprising boots, motorcycle boots, basketball shoes, football shoes, running shoes or other similar kinds of sport footwear.

One of the main drawbacks of known laceless footwear articles is that they may slip out from the foot of the user, for example in case of a crash.

BACKGROUND

This drawback is largely caused by the uppers of the footwear articles not being firmly tightened and retained on the feet of the users during use.

In order to at least partially overcome such drawback, such footwear articles may comprise retention means, for example a zipper, which may be positioned on the upper.

For example, motorcycle boots with such kind of retention means have been provided in order to partially overcome the above drawback.

However, this technical solution manages to solve the above drawback in a limited extent and may further affect the overall fit adjustment of the footwear on the foot of the user.

Another drawback of this technical solution consists in that the same footwear article cannot be properly adjusted for different shapes of the foot.

Further technical solutions have been provided also in technical fields other than that of motorcycle boots, as for example the technical field of basketball shoes.

From US2018020767 a basketball shoe is disclosed with a retention system comprising a closed-loop cord slidably coupled to the upper of the shoe and designed to be handled by the user in order to selectively bring the upper in tightened/loose condition with respect to the foot of the user.

In particular, the basketball shoe comprises fastening means and loosening means, namely a first band or tap and a second band or tap; the two bands or taps are connected at different portions of the closed-loop cord.

The first band or tab is positioned at the heel portion of the shoe and it is designed to be pulled by the user for tensioning the closed-loop cord and for tightening the upper on the foot; the second band or tab is positioned at the top instep of the foot and it is designed to be pulled by the user for loosening the closed-loop cord and the upper.

The first band or tab may be locked in position upon having been pulled by the user by suitable locking means.

The basketball shoe may also comprise mechanical devices, as for example a box-like device positioned in the outsole of the shoe. One or more sections of the closed-loop cord pass through the box-like device so as to prevent the accidentally sliding of the cord from the tensioned condition to the loose condition and vice versa.

A drawback of the above solution is that the retention system is integral with the upper and/or the outsole of the footwear, rendering the manufacturing process of the footwear particularly complex and time-consuming.

Another drawback consists in that the above retention system cannot be used in combination with preexisting models of footwear articles, unless these latter are deeply modified.

Further, another drawback is that the retention system is particularly complex and hindering, especially considering the box-like device for locking the closed-loop cord.

In this regard, the shoe with such retention system could even result to be uncomfortable for the user.

A further drawback is that the retention system does not provide an effective support and protection to the heel of the foot of the user.

BRIEF SUMMARIES OF OBJECTS OF THE INVENTION

The main object of the present invention is therefore to provide a footwear with a retention system designed to overcome the drawbacks mentioned above.

More specifically, the main object of the present invention is to provide a footwear as disclosed above which allows to maintain the foot of the user stably retained thereby, when necessary.

Another object of the present invention is to provide a footwear as disclosed above that allows to be adjusted in order to fit with the foot shape.

A further object of the present invention is to provide a footwear as disclosed above without hindering parts and being particularly comfortable for the user.

Another object of the present invention is to provide a footwear as disclosed above which does not need the known manufacturing processes of footwear articles to be modified.

A further object of the present invention is to provide a footwear as disclosed above which provides an effective support and protection to the heel of the foot of the user.

Another object of the present invention is to provide a footwear as disclosed above which eases the step of tightening the footwear on the foot of the user.

The above-mentioned objects, and other objects that will better appear in the following of the present description, are achieved by a footwear with retention system according to claim 1.

BRIEF DESCRIPTIONS OF THE DRAWINGS

The advantages and the characteristic features of the invention will appear more clearly from the following description of preferred, but not exclusive, embodiments of the invention which refer to the accompanying figures in which:

FIG. 1 is a perspective view of the retention system of the footwear according to a first embodiment of the invention fitted on a last resembling a foot;

FIGS. 2*a* and 2*b* are a bottom perspective view and a bottom view of the retention system shown in FIG. 1;

DETAILED DESCRIPTION OF EMBODIMENTS OF THE INVENTION

Figure 1:
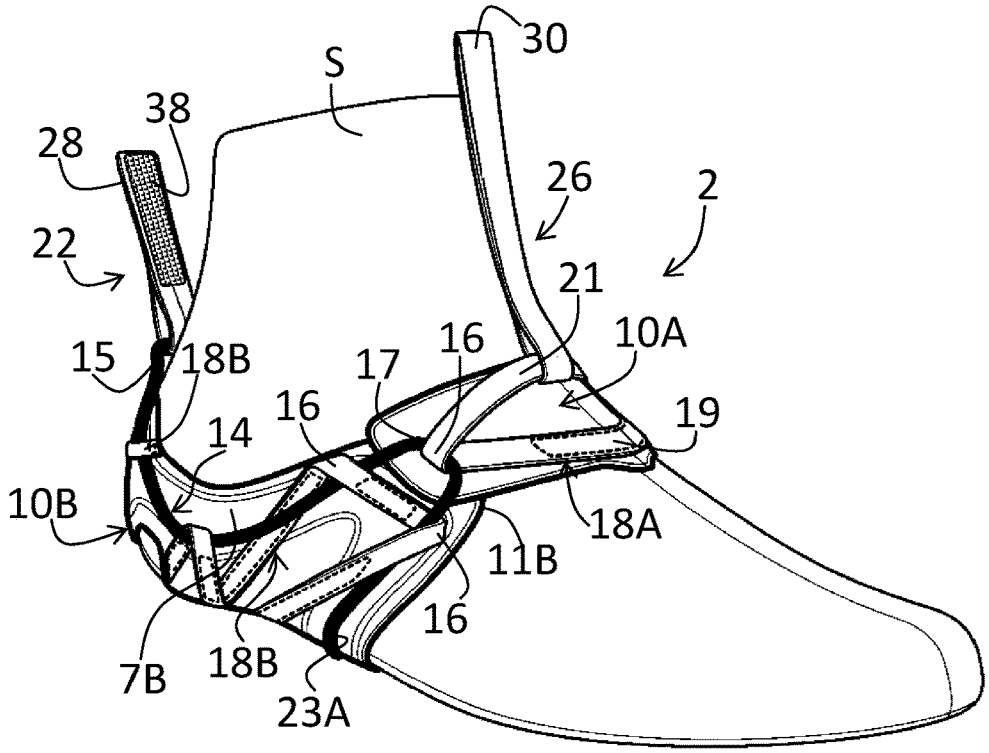

The present invention relates to a footwear with a retention system. The footwear is indicated as overall with the reference number 1, while the retention system is indicated as overall with the reference number 2.

Further, a first embodiment of the footwear 1 is shown in FIGS. 3-7 while a first embodiment of the retention system 2 is shown as a single part in FIGS. 1, 2*a*-2*b* and 8. In particular, in these latter figures the retention system 2 is shown fitted on a last S resembling a foot.

A second embodiment of the footwear 1 and of the retention system 2 is shown in FIGS. 9-13.

Advantageously and as already noted above, the footwear 1 of the present invention can be a boot, a motorcycle boot, a basketball or football shoe, a cycling shoe, a running shoe or another similar footwear article.

By way of example, the footwear 1 of the first embodiment shown in FIGS. 3-7 is a boot, without prejudice to the scope of protection of the present invention.

Further, the footwear 1 of the second embodiment shown in FIGS. 9-13 is a Touring boot.

As it can also be seen from the figures, the footwear 1 of the present invention is a laceless footwear.

In a manner known per se and as better shown in FIGS. 3, 4-7 and 9-13, the footwear 1 comprises an upper 4 delimiting an inner space for the foot of the user and an outsole 5 joined to the bottom part of the upper 4 and designed to be in contact with the ground when the footwear 1 is worn by the user. The outsole is shown only in the figures relating to the second embodiment of the footwear 1.

Figure 2A:
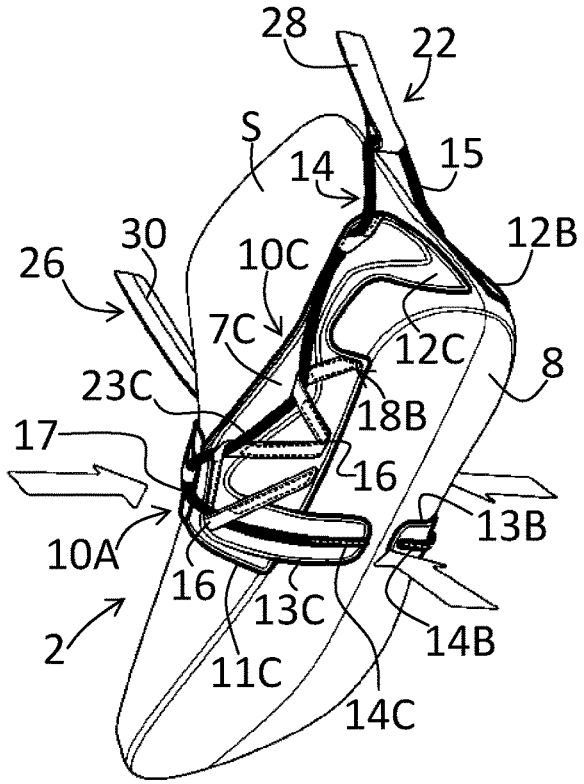
Figure 2B:
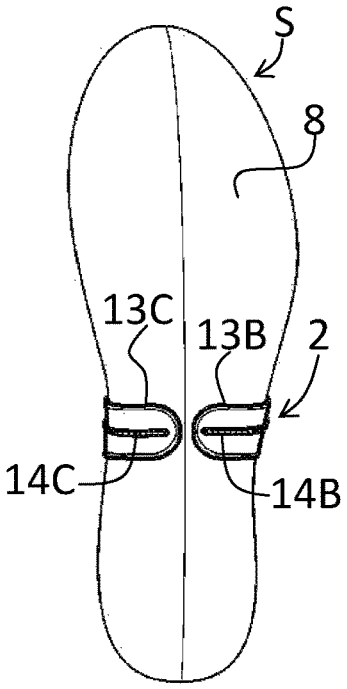

Further, the footwear 1 comprises an insole 8 provided at the bottom part of the upper 4 and designed to be in contact with the upper part of the outsole. In FIGS. 2*a*, 2*b* the insole 8 is applied to the last S resembling the foot, while in FIGS. 9-13 the insole is not visible.

Figure 3:
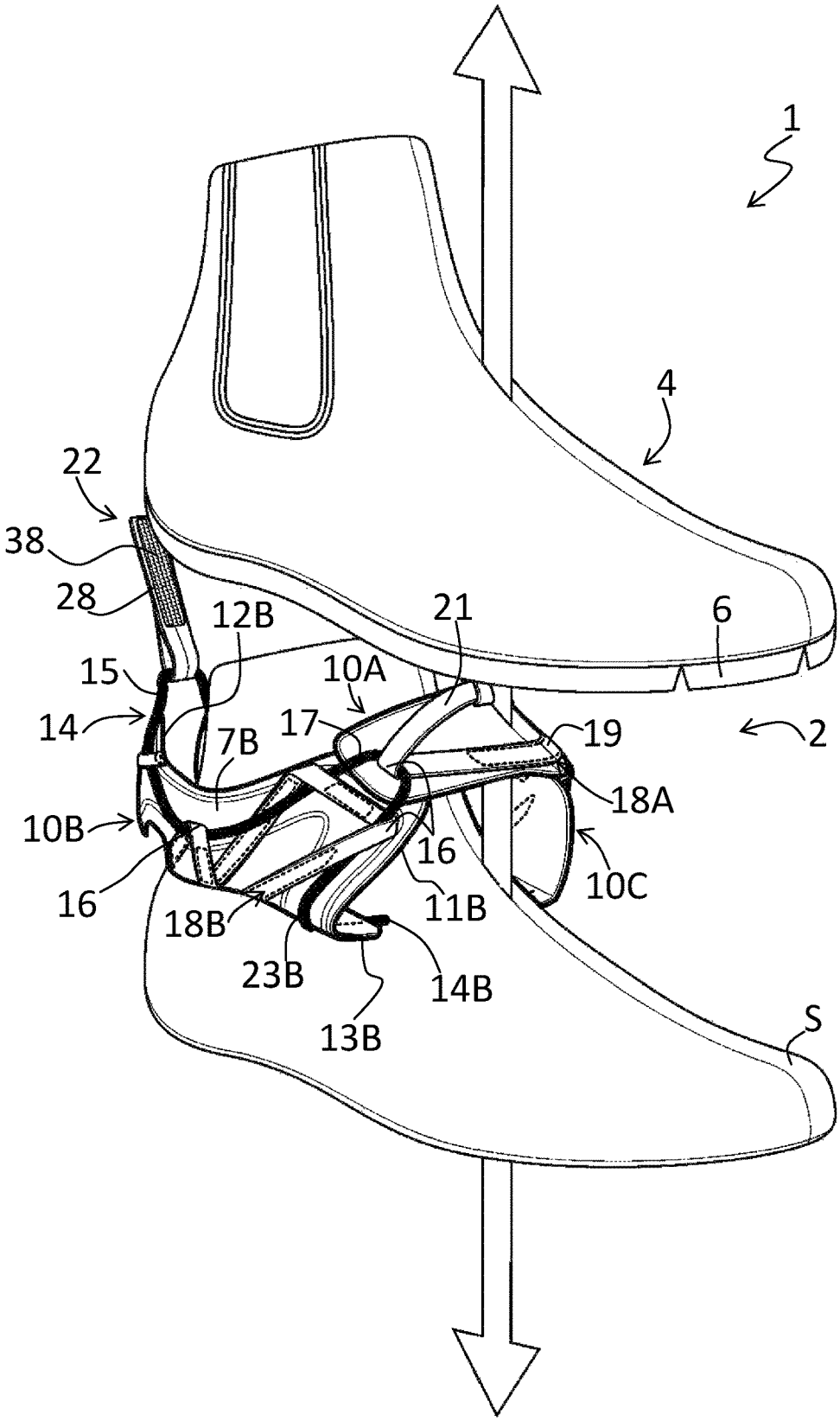
FIG. 3 is an exploded perspective view of the footwear according to the first embodiment of the invention and of the last shown in FIG. 1.

As shown in FIG. 3, the upper 4 comprises an edge 6 designed to be folded on the insole 8 for securing the insole 8 to the upper 4.

The materials and methods for the manufacturing of the upper, the insole and the outsole are well known in the art and thus they will not be further described in the present specification. The footwear 1 may further comprise an inner lining of the known type and not visible in the attached figures; the inner lining may be positioned on the inner side of the upper 4 facing the inner space.

The retention system 2 is positioned at least partially in the inner space formed by the upper 4; as a matter of fact, the retention system 2 is almost entirely positioned in the inner space, as better shown in FIGS. 3, 4-7 and 9-12, in order to be directly in contact with the foot or to be in proximity of the foot.

Thus, the retention system 2 at least partially wraps the foot of the user.

Advantageously, the retention system 2 can be at least partially positioned between the upper 4 and the inner lining, where present, a space between the upper 4 and the inner lining being present for the reasons explained below.

Further, the retention system 2 may be at least partially fastened to the upper 4 at the inner side thereof by suitable securing means, regardless of the inner lining being present. The securing means are not shown in the figures.

The retention system 2 comprises at least one constraint element 10A, 10B, 10C designed to be positioned at the top instep area or at the side/heel area of the foot of the user.

Preferably, the at least one constraint element 10A, 10B, 10C is a flexible element.

In the context of the present specification, the expression "flexible element" indicates an element which is made of a yielding or soft material and/or which is able to be deformed in order to adapt to the shape of the corresponding part of the foot.

The yielding or soft material of the at least one constraint element 10A, 10B, 10C can be chosen in the group comprising leather, fabric and textile. These materials allow the at least one constraint element 10A, 10B, 10C to adapt to the shape of the part of the foot it is positioned on.

The at least one constraint element 10A, 10B, 10C is designed to pass from a loose condition to a tightened condition with respect to the foot of the user, and vice versa.

In the preferred embodiment shown in the attached figures, the retention system 2 comprises a plurality of constraint elements 10A, 10B, 10C which are at least partially movable there between for passing from the loose condition to the tightened condition and vice versa.

Each of the constraint elements 10A, 10B, 10C may be a flexible element for wrapping the foot of the user.

In particular, each constraint element 10A, 10B, 10C is a single piece with a predetermined extension for covering a respective part of the foot of the user.

Figure 5:
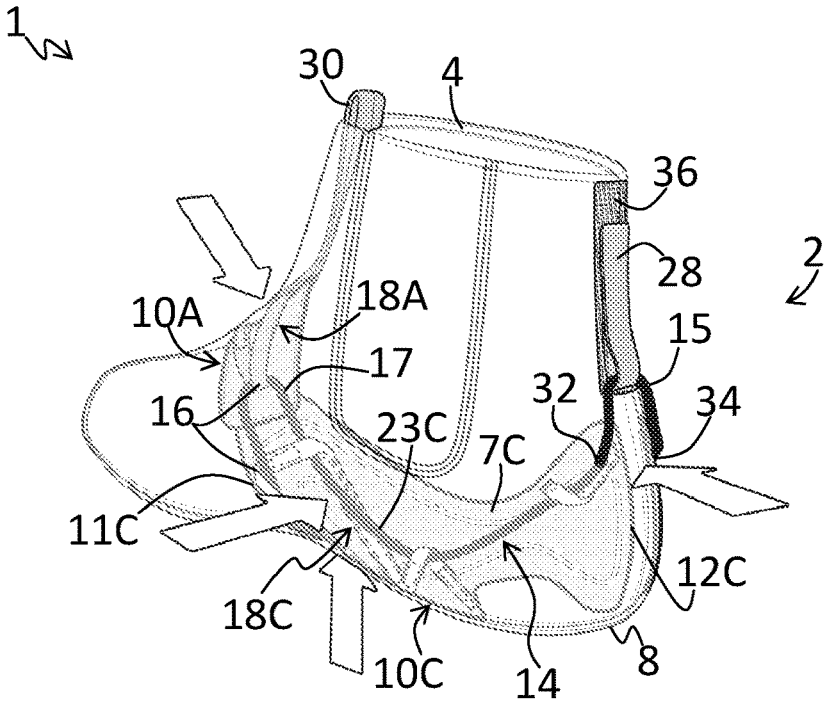
Figure 7:
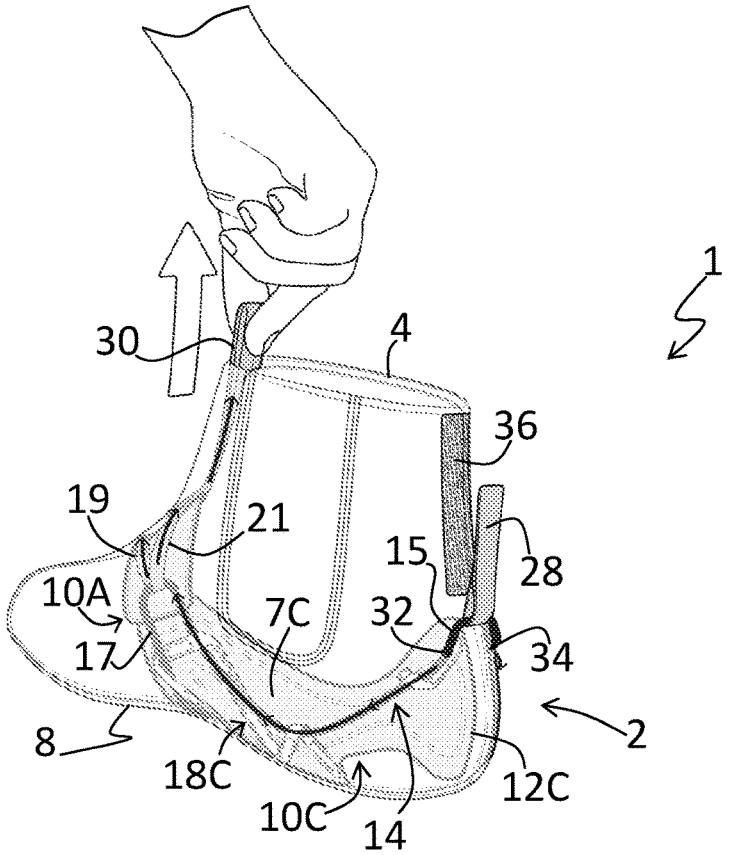

With reference to the first embodiment of the footwear 1, the constraint elements 10A, 10B, 10C in tightened condition are illustrated in FIG. 5, with the arrows indicating the forces thereof acting on the foot whereas the constraint elements 10A, 10B, 10C in loose condition are shown in FIG. 7.

Figure 9:
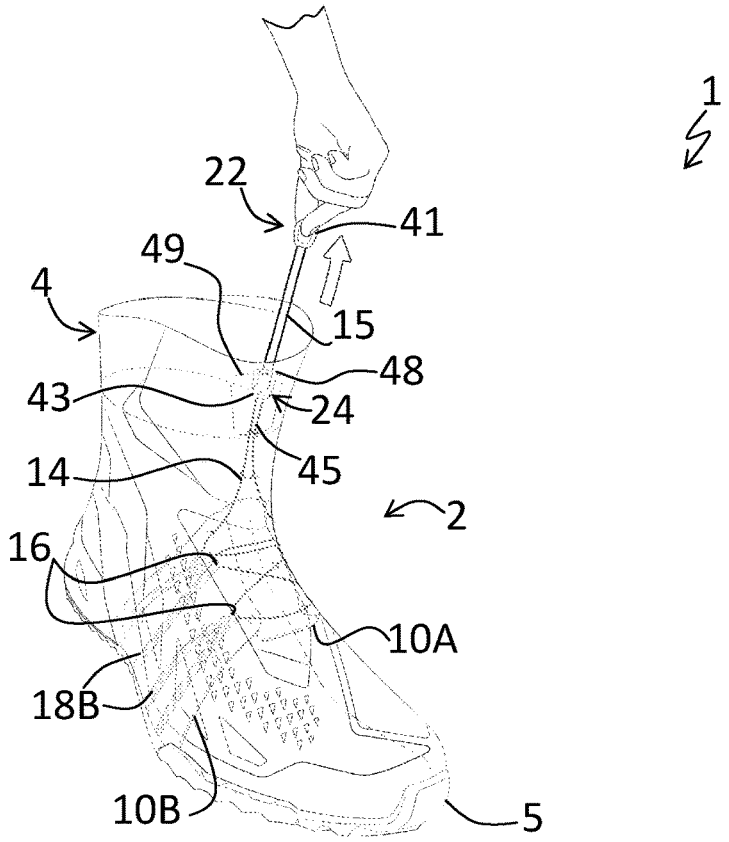
FIGS. 9-12 are perspective views of different steps of the method of use the footwear according to a second embodiment of the invention.
Figure 10:
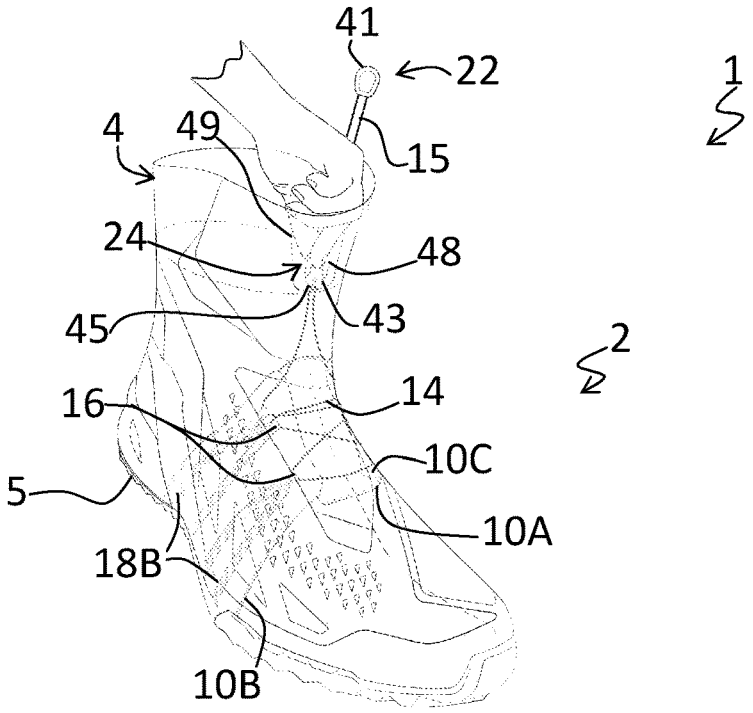
Figure 12:
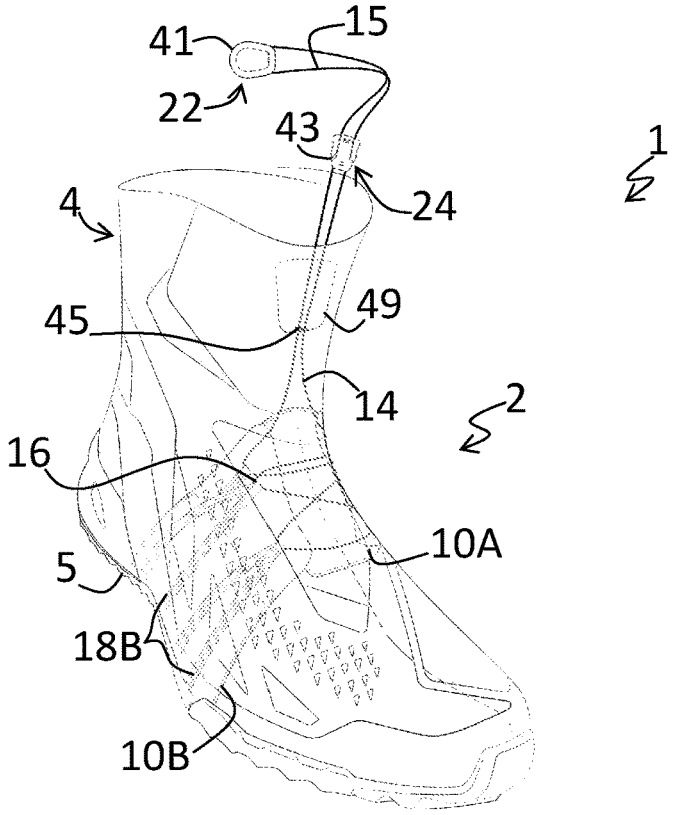

With reference to the second embodiment of the footwear 1, FIGS. 9-10 show the constraint elements 10A, 10B, 10C in the tightened condition and FIG. 12 shows the constraint elements 10A, 10B, 10C just before being moved to the loose condition.

The method of use of the retention system 2 for moving the constraint elements 10A, 10B, 10C from the loose condition to the tightened condition and vice versa will be better explained in the following and according to FIGS. 4-7 for the first embodiment and according to FIGS. 9-13 for the second embodiment.

Opportunely, all the constraint elements 10A, 10B, 10C of the retention system 2 are at least partially fastened to the inner side of the upper 4 and may be positioned between the upper 4 and the inner lining, where present.

As better illustrated in FIGS. 1, 2*a*, 3 and 8, one constraint element 10A is designed to be positioned at the top instep of the foot of the user and two constraint elements 10B, 10C are designed to be positioned at the side/heel areas of the foot.

In the second embodiment of the footwear 1, one constraint element 10A is designed to be positioned at the top instep of the foot and two constraint elements 10B, 10C are designed to be positioned at the side areas of the foot.

The surfaces of the constraint elements 10A, 10B, 10C are designed to cover and wrap the parts of the foot indicated above.

Further and as partially shown in FIGS. 9-12, the lower parts of the side constraint elements 10B, 10C of the second embodiment of the footwear 1 may be secured to the insole 8, while the constraint element 10A positioned at the top instep of the foot may be secured only to the inner surface of the upper 4.

The number of constraint elements could also be different, without any limitation for the scope of protection of the present invention.

In the following and for sake of clarity the constraint element 10A will be referenced as "instep constraint element" while the other two constraint elements 10B, 10C will be referenced as "side/heel constraint elements" or "side constraint elements".

The constraint elements 10A, 10B, 10C may have different shapes. For example, in the first embodiment the side/heel constraint elements 10B, 10C may each be a single piece with a central portion 7B, 7C and two shaped portions extending therefrom, namely a first shaped portion 11B, 11C and a second shaped portion 12B, 12C.

As better shown in FIG. 1, the central portion 7B, 7C is designed to cover the side of the foot, the first shaped portion 11B, 11C is designed for partially covering the side part of the instep of the foot and the second shaped portion 12B, 12C is designed for partially covering the heel of the foot.

Figure 8:
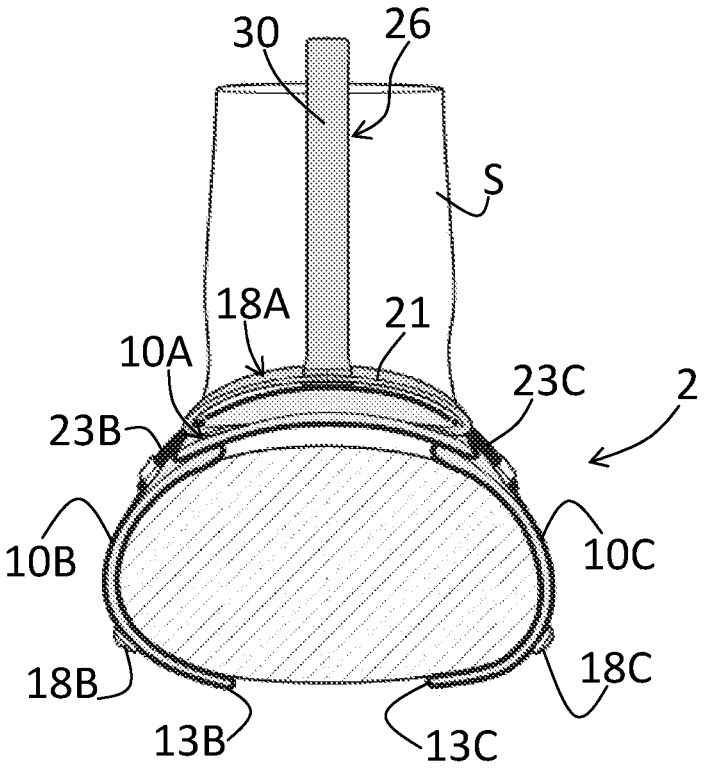
FIG. 8 is a front sectioned view of the last with the retention system of the first embodiment fitted thereon.

Advantageously, each of the side/heel constraint elements 10B, 10C of the first embodiment of the footwear 1 may also comprise a projection 13B, 13C, better visible in FIGS. 2*a*, 2*b* and 8, whose function will be better explained in the following.

Each projection 13B, 13C of the side/heel constraint elements 10B, 10C is preferably secured to the bottom part of the insole 8 or of the upper 4; alternatively, each projection 13B, 13C may be secured to other parts of the upper 4.

By way of example, the projections 13B, 13C shown in FIGS. 2*a* and 2*b* are secured to the insole 8, in proximity of the arch of the foot.

Further, in the first embodiment the instep constraint element 10A is partially overlapped at its side ends to the side/heel constraint elements 10B, 10C, in particular to the first shaped portions 11B, 11C thereof, as better shown in FIGS. 1 and 3.

Alternatively, in the second embodiment of the footwear 1 the two side constraint elements 10B, 10C are partially overlapped to the top instep constraint element 10A at the opposite sides thereof as shown in FIGS. 9-12 and are movable with respect to the instep constraint element 10A which is preferably secured to the upper 4.

The degree of overlap between the instep constraint element 10A and the side/heel constraint elements 10B, 10C may be bigger when the constraint elements 10A, 10B, 10C are in the tightened condition.

Moreover, in the tightened condition the constraint elements 10A, 10B, 10C occupy a volume which is smaller than the volume occupied thereby in the loose condition with respect to the foot of the user. In this way the volume of the footwear 1 is reduced as well when the retention system 2 passes from the loose condition to the tightened condition.

The above configurations are not visible in the attached figures.

The retention system 2 further comprises a cord 14 slidably coupled to the at least one constraint element 10A, 10B, 10C. In the embodiment shown in the figures the cord 14 is slidably coupled to at least two of the constraint elements 10A, 10B, 10C.

In particular, in the footwear 1 of the first embodiment the cord 14 is slidably coupled to each of the constraint elements 10A, 10B, 10C while in the footwear 1 of the second embodiment the cord 14 is slidably coupled only to the side constraint elements 10B, 10C.

In this configuration the cord 14 maintains the constraint elements 10A, 10B, 10C coupled there between.

The space formed between the upper 4 and the lining allows the sliding of the cord 14 with respect to the constraint elements 10A, 10B, 10C without breakings thereof. In this regard, the upper 4 and the inner lining may further comprises a low friction material at the inner surfaces thereof for further easing the sliding of the cord 14.

Further, the cord 14 can be made of textile fibers, of an elastic material or of synthetic fibers. In the first embodiment of the footwear 1, the free ends 14B, 14C of the cord 14 may be secured to the bottom part of the upper 4 or of the insole 8.

In particular, the free ends 14B, 14C of the cord 14 may be secured to each of the projections 13B, 13C of the side/heel constraint elements 10B, 10C, as illustrated in FIGS. 2*a* and 2*b*. The at least one constraint element 10A, 10B, 10C can comprise one or more eyelets 16 for the passage of the cord 14. If a plurality of constraint elements 10A, 10B, 10C is provided at least two of them comprise one or more eyelets 16.

In the first embodiment each of the constraint elements 10A, 10B, 10C comprises one or more eyelets 16 for the passage of the cord 14.

For example, the side/heel constraint elements 10B, 10C can comprise four eyelets 16 distributed throughout their extension and the instep constraint element 10A can comprise two eyelets 16 positioned at the side ends thereof.

In the second embodiment, only the two side constraint elements 10B, 10C comprise one or more eyelets 16 for the passage of the cord 14.

Obviously, a different number of eyelets 16 may be provided in order to better support the cord 14 during the sliding thereof relative to the constraint elements 10A, 10B, 10C.

The eyelets 16 can be formed by at least one tape 18A, 18B, 18C secured to the at least one constraint element 10A, 10B, 10C. The eyelets 16 can be formed by tapes 18A, 18B, 18C secured to the constraint elements 10A, 10B, 10C, in particular on the surface of the constraint elements 10A, 10B, 10C which is oriented on the opposite side of the foot.

In the first embodiment of the footwear 1:

- each of the side/heel constraint elements 10B, 10C comprises two tapes 18B, 18C and the eyelets 16 are formed at the fixing points of the tapes 18B, 18C on the respective side/heel constraint element 10B, 10C.
- the instep constraint element 10A comprises a close-loop tape 18A with a portion 19 secured to the outer face of the instep constraint element 10A and a free portion 21; in this case the eyelets 16 are formed at the joints of the two portions 19, 21 of the strip 18A.

In the second embodiment of the footwear 1:

- each of the side constraint elements 10B, 10C comprises two tapes 18B, 18C each forming a respective eyelet 16;
- the instep constraint element 10A has no tapes or eyelets;
- the cord 14, passing through the eyelets 16 of the side constraint elements 10B, 10C, forms crossing portions.

The retention system 2 further comprises:

tensioning means 22 connected to a first portion 15 of the cord 14 and designed to be handled by the user for bringing the cord 14 into a tensioned condition in order to bring the at least one constraint element 10A, 10B, 10C in the tightened condition;

locking means 24 for locking the cord 14 in tensioned condition.

In the tensioned condition the cord 14, once having been pulled and tensioned by the user, maintains the constraint elements 10A, 10B, 10B constrained on the foot.

The loose condition of the at least one constraint element 10A, 10B, 10C may be obtained when the cord 14 is no more locked by the locking means 24 in the tensioned condition upon having been pulled, as shown in FIG. 12 with reference to the second embodiment of the footwear 1.

The retention system 2 may further comprise loosening means 26 connected to at least one second portion 17 of the cord 14 and designed to be handled by the user for bringing the at least one constraint element 10A. 10B, 10C in the loose condition.

As a matter of fact, in the embodiments shown in the figures the tensioning means 22 and the loosening means 26 can be grasped by the user to pull the cord 14 and thus to bring all the constraint elements 10A, 10B, 10C respectively in the tightened condition and in the loose condition, being the constraint elements 10A, 10B, 10C coupled there between by the cord 14.

Advantageously, the tensioning means 22 and the loosening means 26 of the first embodiment of the footwear 1 may comprise respective bands 28, 30.

According to such embodiment, the band 28 of the tensioning means 22 is connected to the first portion 15 of the cord 14, such first portion 15 being positioned at the heel area of the upper 4.

Further, the first portion 15 of the cord 14 and the band 28 connected thereto are positioned outside the upper 4 of the footwear 1, as shown in FIGS. 4-7.

Thus, the band 28 and the first portion 15 of the cord 14 are the parts of the retention system 2 which are not positioned in the inner space of the upper 4.

In this regard, the upper 4 may comprise an exit hole 32 and an entry hole 34 positioned at the heel area of the upper 4 and allowing exit and entry of the cord 14 at the first portion 15, as shown in FIGS. 5 and 7.

In the first embodiment of the footwear 1, the cord 14 further comprises a pair of sections 23A, 23B between the respective free end 14B, 14C and the first portion 15. The two sections 23A, 23B are positioned at the sides of the foot when the footwear 1 is worn by the user.

Each section 23A, 23B defines a respective second portion 17 of the cord 14. In particular, each second portion 17 of the sections 23A, 23B passes through the eyelet 16 located at a respective side end of the instep constraint element 10A and formed by the tape 18A.

The band 30 of the loosening means 26 is positioned at the top instep of the foot and is connected to the tape 18A of the instep constraint element 10A, more in particular to the free portion 21 of such tape 18A, as shown in FIG. 1

Thus, the loosening means 26, namely the band 30, are at least indirectly connected to the at least one second portion 17 of the cord 14, namely to both the second portions 17 of the cord 14.

Further, the band 30 of the loosening means 26 is at least partially positioned inside the upper 4 but has a portion emerging there from, as shown in FIGS. 4-7; such portion is that designed to be grasped by the user when the footwear 1 is worn.

The locking means 24 of the first embodiment of the footwear 1 can be positioned on the upper 4 of the footwear 1 and may comprise a hook and loop stripe 36 positioned on the heel part of the upper 4, as shown in FIGS. 4-7.

The band 28 of the tensioning means 22 is designed to be secured to the hook and loop stripe 36 upon being grasped by the user for maintaining the cord 14 in the tensioned condition and the constraint elements 10A, 10B, 10C in the tightened condition, as shown in FIG. 5.

In this regard, the band 28 of the tensioning means 22 comprises a corresponding hook and loop stripe 38 positioned on the surface of the band 28 oriented towards the upper 4 of the footwear 1. Such hook and loop stripe 38 is better shown in FIGS. 1 and 3.

The band 28 of the tensioning means 22 can be secured to the hoop and look stripe 36 of the locking means 24 as it is positioned, with the first portion 15 of the cord 14, outside the upper 4.

In the second embodiment of the footwear 1, the tensioning means 22 comprise a puller tab 41 designed to be grasped by the user and the free ends of the cord 14 are secured to the puller tab 41, thus forming the first portion 15 of the cord 14 fastened to the tensioning means 22, as shown in FIGS. 9-12.

Further, in such second embodiment the locking means 24 comprise a locking device 43 designed to pass from an inoperative position (see FIGS. 9 and 12) wherein the locking device 43 allows the sliding of the cord 14 there through and an operative position (see FIGS. 10 and 11) wherein the locking device 43 prevents the sliding of the cord 14 there through.

In particular, the locking device 43 has two passages (not visible in the figures) for two sections of the cord 14 corresponding to the free ends thereof.

The operative position of the locking device 43 is defined by a pair of stop elements 45 placed at the respective sections of the cord 14; further, the user may move the locking device 43 in the operative position by pushing the retractable side portions 48 of the locking device 43 in order to free the passages for the sliding of the cord 14 and by making the locking device 43 slide along the cord 14 until it reaches the stop elements 45. In this second embodiment the loosening means 26 may be defined by the locking device 43 moved in the inoperative position and the first portion 15 of the cord 14 substantially coincides with the second portion 17 of the cord 14 described above with reference to the first embodiment.

Figure 13:
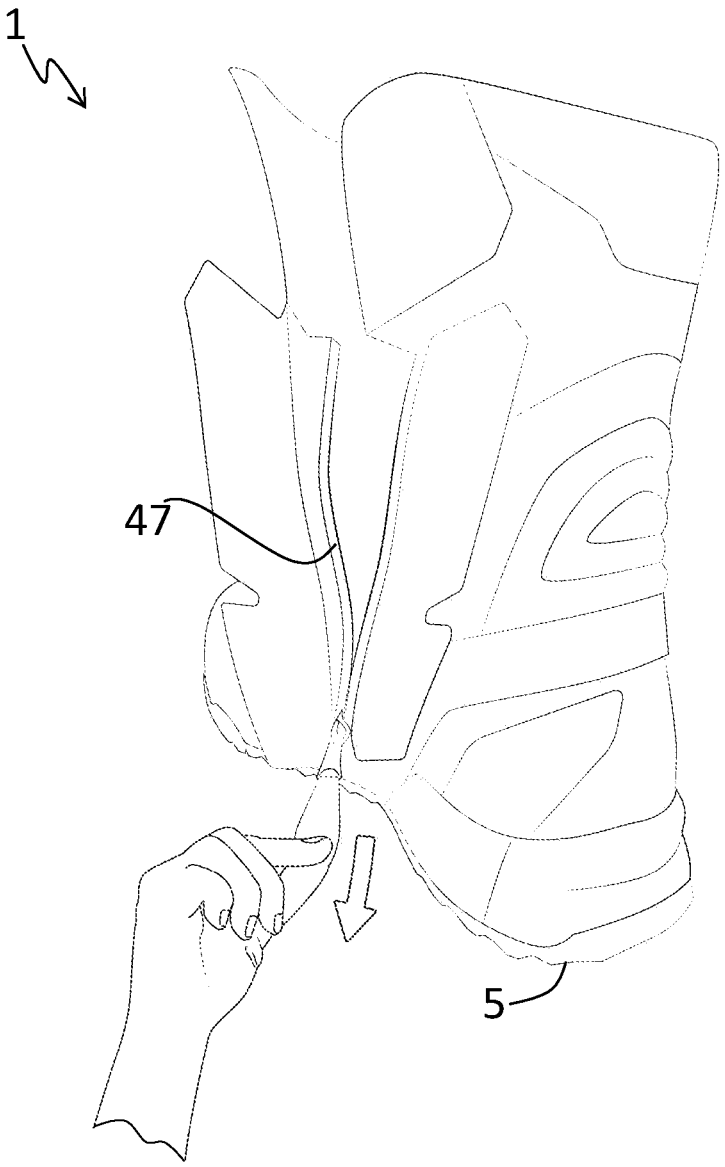
FIG. 13 is a rear perspective view of the second embodiment of the footwear shown in FIGS. 9-12 with a further particular shown.

The footwear 1 of the second embodiment may further comprises a zip 47 of the known type and shown in FIG. 13. The zip 47 is positioned in the upper 4, preferably in the side area thereof and it is designed to be closed once the retention system 2 has been moved in the tightened condition.

Figure 11:
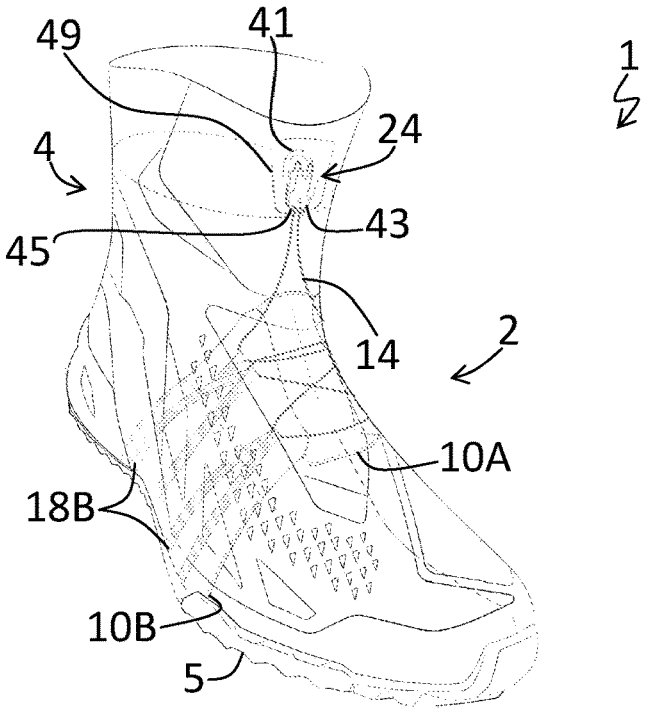

The second embodiment of the footwear 1 may also comprise a pocket 49 in the inner side of the upper 4, the pocket 49 being designed to house the puller tab 41 once the user has pulled it and locked the cord 14 in the tensioned condition, as shown in FIG. 11.

Figure 4:
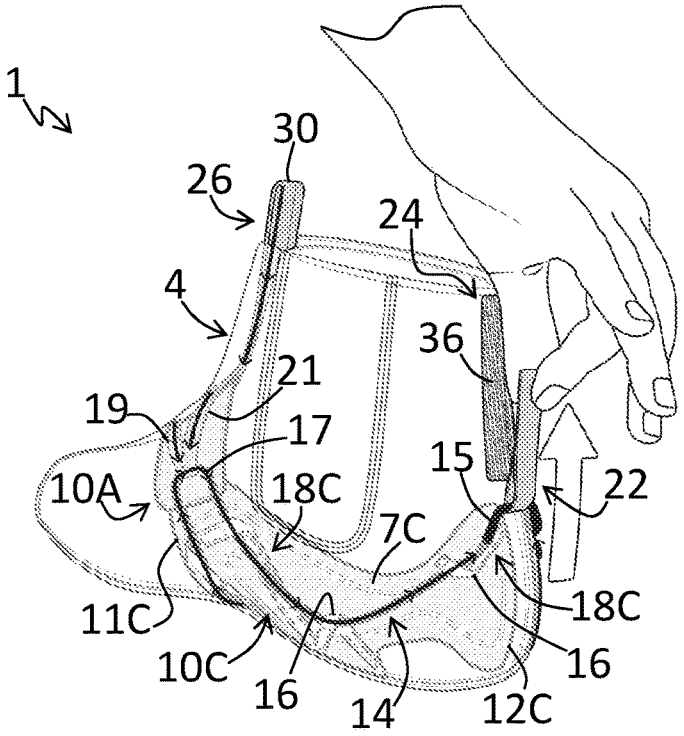
FIGS. 4-7 are perspective views of different steps of the method of use of the footwear according to the first embodiment of the invention with the retention system shown in transparency through the upper.

With further reference to the first embodiment of the footwear 1, the method of use of the retention system 2 comprises the following steps, once the footwear 1 has been worn by the user:

i) pulling the band 28 of the tensioning means 22 for moving the cord 14 in the tensioned condition and for moving the constraint elements 10A, 10B, 10C in the tightened condition until the user feels the upper 4 is stably retained on the foot and fit-adjusted on the foot;

this step is shown in FIG. 4, with the white arrow indicating the pulling direction of the band 28;

ii) securing the band 28 of the tensioning means 22 on the hook and loop stripe 36 of the locking means 24 with the cord 14 in tensioned condition by using the stripe 38 on the band 28; this step is shown in FIG. 5.

Step i) causes the sliding of the cord 14 along the eyelets 16 formed in the constraint elements 10A, 10B, 10C and thus the movement thereof and their constraint on the foot of the user.

In particular, in FIG. 4 the directions of sliding of the cord 14, of the tape 18A in the instep constraint element 10A and of the band 30, once the user has pulled the band 28, are shown with black arrows.

Figure 6:
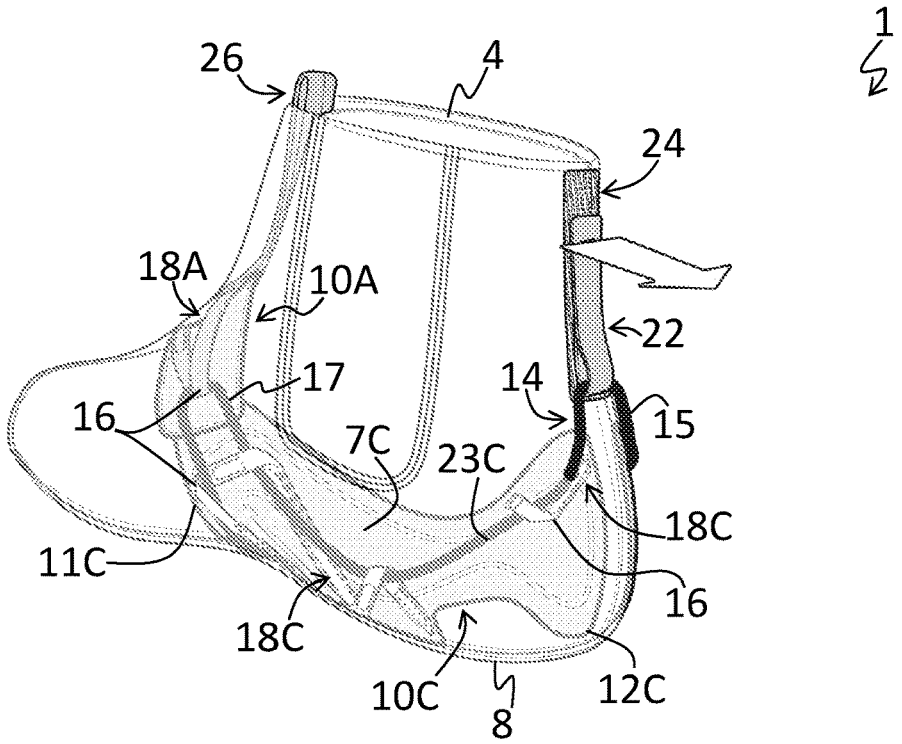

When the user wants to remove the footwear 1 from his/her foot, he/she has to detach the band 28 of the tensioning means 22 from the hook and loop stripe 36 of the locking means 24 as shown in FIG. 6 and he/she has to pull the band 30 of the loosening means 26 for loosening the cord 14 and for moving the constraint elements 10A, 10B, 10C in the loose condition as shown in FIG. 7.

In particular, the directions of sliding of the cord 14 and of the tape 18A in the instep constraint element 10A during the moving into the loose condition are shown with black arrows in FIG. 7.

In the loose condition the instep constraint element 10A may have a degree of overlap with respect to the side constraint elements 10B, 10C which is smaller than the degree of overlap of the constraint elements 10A, 10B, 10C in the tightened condition.

Obviously, the band 28 of the tensioning means 22 may be detached from the hook and loop stripe 36, pulled by the user and secured again to the stripe 36 when the cord 14 has to be brought in a more tensioned condition.

With reference to the second embodiment of the footwear 1, the method of use of the retention system 2 comprises the following steps, once the footwear 1 has been worn by the user:

iii) pulling the tab 41 of the tensioning means 22 with the locking device 43 in the inoperative position for moving the cord 14 in the tensioned condition and for moving the constraint elements 10A, 10B, 10C in the tightened condition;

iv) moving the locking device 43 in the operative position by sliding it along the cord 14 with this latter being in tensioned condition.

When the user wants to bring the constraint elements 10A, 10B, 10C in the loose condition he/she has to move again the locking device 43 in the inoperative position, leaving the cord 14 to slide backwards. If the user wants to remove the footwear 1 from the foot, he/she has to further open the zip 47.

It is clear now how the present invention allows to achieve the predefined objects.

The footwear of the present invention allows to be retained and fit-adjusted on the foot of the user in a simple way without affecting the comfort thereof.

As a matter of fact, the retention system of the present invention is only partially integrated in the upper of the footwear and does not comprise hindering components.

Moreover, the retention system of the present invention eases the step of tightening the footwear on the foot of the user and also gives support to the heel of the user.

With regard to the embodiments of the footwear described above, the person skilled in the art may, in order to satisfy specific requirements, make modifications to and/or replace elements described with equivalent elements, without thereby departing from the scope of the accompanying claims.

The invention claimed is:

1. A footwear with retention system, the footwear comprising an upper delimiting an inner space for a foot of a user, wherein the retention system is positioned at least partially in the inner space of said upper and comprises:

a plurality of constraint elements which are at least partially movable there between and designed to pass from a loose condition to a tightened condition with respect to the foot of the user and vice versa;

a first constraint element of the plurality of constraint elements designed to be positioned at a top instep area of the foot of the user;

a cord slidably coupled to the plurality of constraint elements;

tensioning means connected to a first portion of the cord and designed to be handled by the user for bringing the cord into a tensioned condition in order to bring the plurality of constraint elements in the tightened condition;

locking means for locking the cord in tensioned condition;

loosening means connected to at least one second portion of the cord and designed to be handled by the user for bringing the constraint elements in the loose condition, the loosening means comprising a band;

wherein each constraint element of the plurality of constraint elements comprises a body and a tape secured to the body, the tape forming one or more eyelets for passage of the cord; and wherein the band of the loosening means is fastened to one of the tape of the first constraint element.

2. The footwear according to claim 1, characterized in that a second constraint element and a third constraint element of the plurality of constraint elements are designed to be positioned at side heel areas or at side areas of the foot of the user, respectively.

3. The footwear according to claim 2, characterized in that the plurality of constraint elements are flexible elements and are made of a yielding material.

4. The footwear according to claim 1, characterized in that the plurality of constraint elements are flexible elements and are made of a yielding material.

5. The footwear according to claim 1, characterized in that the tensioning means comprises a band designed to be grasped by the user and in that the locking means comprises a hook and loop stripe positioned on a heel part of the upper, the band of the tensioning means being designed to be secured to the hook and loop stripe upon being pulled by the user for maintaining the cord in tensioned condition.

6. The footwear according to claim 1, characterized in that the cord has terminal ends secured to a bottom part of the upper or of an insole of the footwear.

7. The footwear according to claim 1, characterized in that the tensioning means comprises a puller tab designed to be grasped by the user, the cord being secured to the puller tab.

8. The footwear according to claim 1, characterized in that the locking means comprises a locking device designed to pass from an inoperative position wherein the locking device allows sliding of the cord there through and an operative position wherein the locking device prevents sliding of the cord there through.

* * * * *